US009464840B2

(12) United States Patent
Boyko

(10) Patent No.: US 9,464,840 B2
(45) Date of Patent: Oct. 11, 2016

(54) GAS DEFROSTING SYSTEM FOR REFRIGERATION UNITS USING FLUID COOLED CONDENSERS

(71) Applicant: Hill Phoenix, Inc., Conyers, GA (US)

(72) Inventor: James Boyko, Gorham, ME (US)

(73) Assignee: Hill Phoenix, Inc., Conyers, GA (US)

( * ) Notice: Subject to any disclaimer, the term of this patent is extended or adjusted under 35 U.S.C. 154(b) by 430 days.

(21) Appl. No.: 13/910,878

(22) Filed: Jun. 5, 2013

(65) Prior Publication Data

US 2014/0360216 A1 Dec. 11, 2014

(51) Int. Cl.

| | |
|---|---|
| ***F25B 47/00*** | (2006.01) |
| ***F25D 21/06*** | (2006.01) |
| ***F25B 47/02*** | (2006.01) |
| ***F25D 21/12*** | (2006.01) |

(52) U.S. Cl.

CPC ..... *F25D 21/06* (2013.01); *F25B 47/02* (2013.01); *F25D 21/12* (2013.01); *F25B 2339/047* (2013.01)

(58) Field of Classification Search

CPC F25B 2339/047; F25B 47/02; F25B 25/005; F25B 47/022

USPC ..... 62/278, 277

See application file for complete search history.

(56) References Cited

U.S. PATENT DOCUMENTS

| | | | | |
|---|---|---|---|---|
| 3,636,723 | A | 1/1972 | Kramer | |
| 4,280,335 | A | 7/1981 | Perez | |
| 4,318,277 | A | 3/1982 | Cann et al. | |
| 4,732,007 | A | 3/1988 | Dolan | |
| 5,335,508 | A | 8/1994 | Tippmann | |
| 5,440,894 | A | 8/1995 | Schaeffer et al. | |
| 7,228,692 | B2 * | 6/2007 | Concha et al. | 62/151 |
| 7,316,267 | B2 * | 1/2008 | Kunimoto et al. | 165/240 |
| 7,603,872 | B2 * | 10/2009 | Tanaami et al. | 62/238.7 |
| 8,973,379 | B2 | 3/2015 | Bittner et al. | |
| 2009/0113911 | A1 * | 5/2009 | Nakayama | 62/238.6 |
| 2010/0023171 | A1 | 1/2010 | Bittner et al. | |
| 2011/0083462 | A1 * | 4/2011 | Engelhart et al. | 62/324.1 |
| 2011/0154844 | A1 * | 6/2011 | Lee et al. | 62/278 |
| 2011/0214444 | A1 * | 9/2011 | Yoshii | 62/160 |
| 2013/0194777 | A1 | 8/2013 | Berben et al. | |

OTHER PUBLICATIONS

Hussman Protocol Innovation in Green; Hussman Bulletin 0107_370_protocolco; 2007 Hussman Corporation, USA.

Hill Phoenix InviroPac; Hill Phoenix Bulletin RS-DOI_HPIPv0609; 2009 Hill Phoenix Inc., USA.

Van Wylen et al; Vapor Compression Refrigeration Cycles; Fundamentals of Classical Thermodynamics, 2nd Edition; 1973; pp. 322-323; John Wiley & Sons, Inc., New York, NY, USA.

(Continued)

*Primary Examiner* — Allen Flanigan
*Assistant Examiner* — Filip Zec
(74) *Attorney, Agent, or Firm* — Foley & Lardner LLP

(57) ABSTRACT

A gas defrosting system is disclosed for efficiently defrosting refrigeration units using fluid-cooled condensers. For each refrigeration unit in refrigeration mode, a cool condenser fluid is applied to the condenser to achieve a high thermodynamic efficiency. For each refrigeration unit in defrost mode, a warm defrost fluid is applied to the condenser to expedite the defrost process.

13 Claims, 4 Drawing Sheets

(56) References Cited

OTHER PUBLICATIONS

Conventional Refrigeration Systems, Retail Food Store Refrigeration and Equipment; 2010 ASHRAE Handbook, Refrigeration I-P Edition; 2010; p. 15.19; American Society of Heating, Refrigerating and Air-Conditioning Engineers, Inc.; Atlanta, GA, USA.

Kramer Thermobank System Installation and Maintenance Manual; Kramer Bulletin TTI-803F; Apr. 1997; Kramer, Covington, GA, USA.

Extended European Search Report for application No. EP17140264.7, dated Apr. 2, 2015, 7 pages.

* cited by examiner

"C" DENOTES CONDENSER FLUID; "D" DENOTES DEFROST FLUID

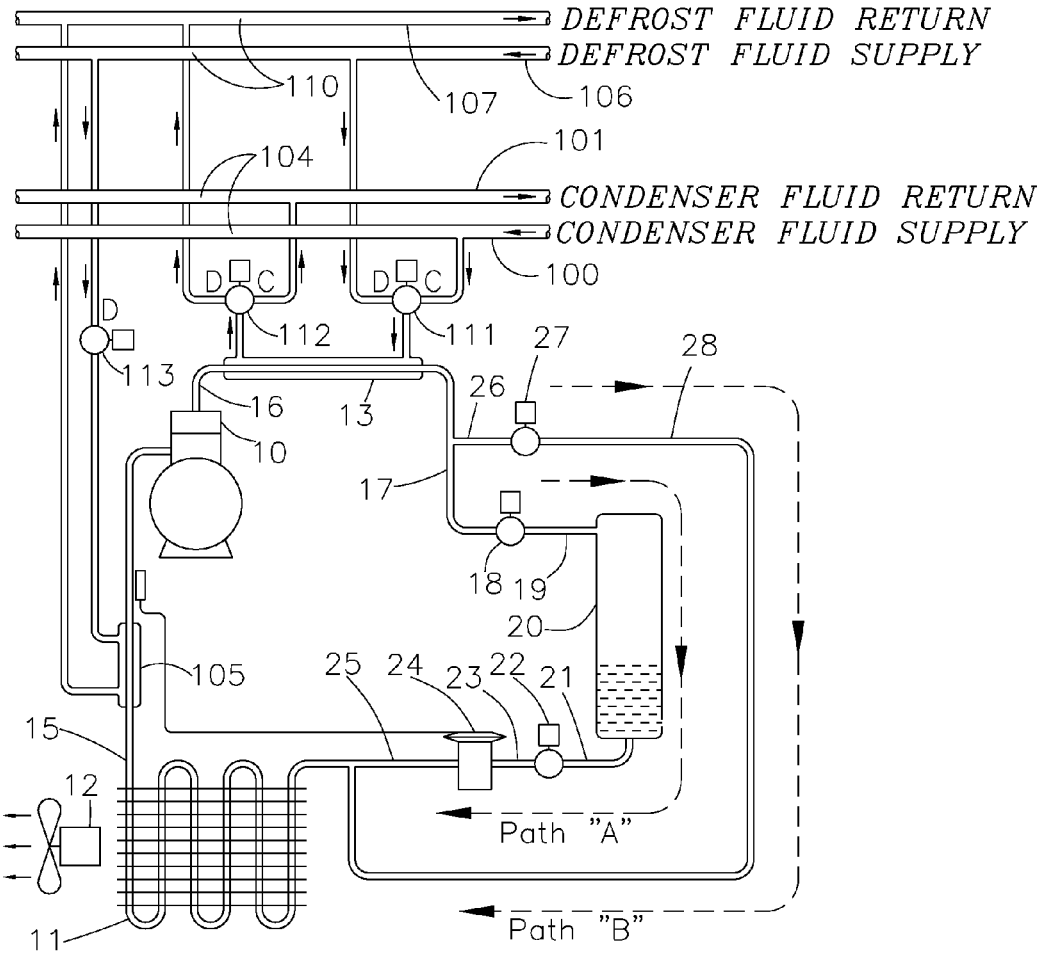

FIG. 4

| MODE | OPERATABLE PART | | | | | | | | NOTES |
|---|---|---|---|---|---|---|---|---|---|
| | 10 | 12 | 111 | 112 | 113 | 18 | 22 | 27 | |
| REFRIGERATION | On | On | C | C | Closed | Open | Open | Closed | #1 |
| DEFROST STEP#1 | On | On | C | C | Closed | Open | Closed | Closed | #2 |
| DEFROST STEP#2 | On | Off | D | D | Open | Closed | Open | Open | #3 |

"C" DENOTES CONDENSER FLUID; "D" DENOTES DEFROST FLUID
Note #1: Terminate when excessive frost forms on evaporator
Note #2: Terminate when all liquid refrigerant captured in receiver
Note #3: Terminate when all frost removed from evaporator

FIG. 5

GAS DEFROSTING SYSTEM FOR REFRIGERATION UNITS USING FLUID COOLED CONDENSERS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates to the field of refrigeration units which requires the periodic removal of frost from the evaporator heat transfer surfaces and more specifically to modular refrigeration units which are cooled by a liquid medium.

The conventional practice for distributing refrigeration over a wide area has been to locate the compressors and condensers in a central area and then connect these components to evaporators which are located adjacent to the refrigeration requirement. The most common example of this condition is the supermarket which typical would locate the compressors and condensers in a machine room in the rear of the building, to be connected with refrigeration pipes to evaporators located in cold cabinets positioned on the sales floor. But this common practice requires a large amount of refrigerant to fill the connecting pipes and is prone to refrigerant leakage from the multitude of joints which connect the pipes. Since common refrigerants are now known to be harmful to the earth's atmosphere, causing ozone depletion and global warming, alternative refrigeration strategies are being applied which reduce the amount of refrigerant used by refrigeration systems. A highly effective strategy, in particular for supermarkets, is to locate all of the refrigeration components adjacent to the refrigeration requirement and then cool the condenser with a heat transfer fluid such as water. In this manner, the extensive network of refrigeration pipes is eliminated and the potential for refrigeration leakage is substantially reduced.

This close-coupled assembly of refrigeration components is called a refrigeration nit for the purpose of the present patent application, but is also referred to as a condensing unit within the refrigeration trade. The as-described cooling of distributed refrigeration units with a cooling fluid is well understood by refrigeration practitioners and fluid-cooled refrigeration units can be readily purchased from refrigeration equipment manufacturers. And a review of patent history indicated that several attributes and improvements have been applied to this standard-practice technique. For example, U.S. Pat. No. 4,280,335 to Perez and U.S. Pat. No. 5,335,508 disclose the implementation of ice storage in conjunction with fluid-cooled refrigeration units in an attempt to utilize inexpensive off-peak electricity. U.S. Pat. No. 4,732,007 to Dolan et al. describes the use of multiple cooling fluids applied to refrigeration units in order to facilitate the retrofitting of existing refrigeration installations and allow for greater operating flexibility. And U.S. Pat. No. 5,440,894 to Schaeffer et al, discloses the implementation of fluid-cooled refrigeration units positioned adjacent to supermarket display fixtures in order to minimize the requisite amount of refrigerant.

In summary, id-cooled refrigeration units offer an effective means for reducing the amount of refrigerant required for distributed refrigeration applications and are currently being installed for this purpose. Examples of these fluid cooled refrigeration units are the Hussman Protocol described by Hussman Bulletin 0107_370_protocolco and the Hill Phoenix InviroPac described by Hill Phoenix Bulletin RS-D01_HPIP Based on the well-understood laws of thermodynamics as explained by Fundamentals of Classical Thermodynamics by Van Wylen et al., these fluid-cooled refrigeration units strive to operate with the lowest possible cooling fluid temperature in order to achieve the lowest possible condensing temperature and subsequently the highest possible efficiency. So during periods of cold weather, the fluid is cooled by the ambient air to as low as 40 F in order to achieve a nominal 50 F condensing temperature, assuming a typically 10 F differential between the condensing temperature and the cooling fluid temperature. In likewise fashion, the fluid could be cooled by an auxiliary refrigeration system such as a chiller to as low as 40 F in order to achieve a nominal 50 F condensing temperature and thus minimize the power requirements for the distributed fluid-cooled refrigeration units.

In review of well-understood refrigeration practice, the typical evaporator collects frost during its normal operation and this frost must be removed on a periodic basis with the application of external heat. A simple and common method for applying this external heat is to embed electric resistance heaters into the evaporator but clearly this method is disadvantaged by use of a substantial amount of expensive electrical energy. This waste of electricity can be avoided by implementing gas defrost in lieu of electric defrost. Methods which perform evaporator defrosting using refrigerant gas are well established by open-source technical publications. As stated by *ASHRAE Handbook-Refrigeration*-2010, *Chapter* 15*: Retail Food Store and Equipment*, compressor discharge gas or gas from the top of the warm receiver at saturated conditions can be directed to the evaporators that require defrosting. And a review of technical literature and patent history indicates that many embellishments to the basic concept have been conceived. For example, during basic gas defrost, the gas can condense to a liquid state and subsequently cause damage to the compressor. To remedy this condition, U.S. Pat. No. 4,318,277 to Cann et al. describes an accumulator for capturing liquid refrigerant returning to the compressor and then the utilization of hot gas from the compressor to vaporize the captured liquid refrigerant. U.S. Pat. No. 3,838,723 to Kramer explains the application of a heater for re-evaporating the captured liquid. And in similar fashion, the Kramer Thermobank concept as described by Kramer Bulletin TT1-803 uses a water tank which is heated by compressor gas for re-evaporating the captured liquid. And most importantly, U.S. patent application Ser. No. 13/560,242 to Boyko discloses a highly effective gas defrost system which is the method of gas defrost preferred by the present inventor.

The present invention relates to a system of fluid-cooled refrigeration units which use gas defrost, ranging in scope from one refrigeration unit to many refrigeration units. In order to fully understand the disclosure of the present invention, the standard-practice system for cooling fluid-cooled refrigeration units is first reviewed.

FIG. 1 shows a common and well-understood system for cooling either a single or multiple fluid-cooled refrigeration units. Each refrigeration unit contains a condenser 13 which must reject heat away from the refrigeration unit during the refrigeration process and this heat is typically called the "heat-of-rejection". Condenser 13 is a heat exchanger with a refrigerant-side and a fluid-side. The fluid inlet for condenser 13 for each refrigeration unit is connected to condenser fluid supply pipe 100 and the fluid outlet of condenser 13 for each refrigeration unit is connected to condenser fluid return pipe 101. Condenser fluid return pipe 101 is connected to the inlet of cooling unit 102. Cooling unit 102 is a fluid chiller, cooling tower or similar cooling device. The outlet of cooling unit 102 is connected to the inlet of condenser fluid pump 103. The outlet of condenser fluid pump 103 is connected to condenser fluid supply pipe 100. Each condenser 13 condenser fluid supply pipe 100, condenser fluid return pipe 101, cooling unit 102 and condenser fluid pump 103 are filled with condenser fluid 104, which is a common heat transfer liquid such as water or glycol. Then, when condenser fluid pump 103 is energized, condenser fluid 104 recirculates between condensers 13 to cooling unit 102 and thus transfers the heat-of-rejection away from condensers 13 to cooling unit 102.

A common feature of all gas defrost systems is the requirement that the condensing temperature must be substantially greater than 32 F, the melting point of frost. This elevated condensing temperature is necessary to adequately transfer heat to the evaporator and complete the defrost process within a short period of time. Based on a review of common refrigeration practice, it is generally perceived that the condensing temperature necessary for effective defrost should be in the range of 80 F. But the potential efficiency improvement achieved by a low condensing temperature is substantial, as shown by FIG. 2 which provides a graphical presentation of efficiency as a function of condensing temperature. FIG. 2 delineates efficiency in terms of Coefficient of Performance (COP) which is calculated as the dimensionless ratio of the refrigeration effect divided by the compressor power. The efficiency differential can be extracted from FIG. 2 which shows that the COP at 50 F condensing is 1.8 times greater than at 80 F condensing with +20 F evaporator temperature and the COP at 50 F condensing is 1.5 times greater than at 80 F condensing with −20 F evaporator temperature.

In summary, a review of technical literature and prior art shows that distribution of fluid-cooled refrigeration units provides a highly effective method for reducing the emission of refrigerant into the atmosphere and thereby should be actively pursued as a means for reducing atmospheric ozone depletion, global warming and, of course, the operational cost due to the lost refrigerant. Nevertheless, current practice does not provide a system for applying gas defrost to fluid-cooled refrigeration units which can provide both quick defrosting and high thermodynamic efficiency by virtue of a low temperature condensing fluid. Therefore, what is needed is a gas-defrost system applicable to fluid-cooled refrigeration units which is not detrimentally impacted by a low temperature condenser fluid. And in order to achieve commercial viability, what is further needed is a gas defrost system applicable to fluid-cooled refrigeration units which can be easily and reliably implemented.

BRIEF SUMMARY OF THE INVENTION

Gas defrost offers a fast and efficient method of defrost for fluid cooled refrigeration units but a problem remains in reconciling the optimum condenser fluid temperature. Specifically, if the condenser fluid temperature is too low, generally lower than 80 F, the duration of the defrost process will be impractically long. But if the condensing water temperature is maintained at a high level, then the thermodynamic efficiency of the refrigeration unit will be compromised.

In order to remedy this problem, the present invention strives to replace the condenser fluid during the defrost process with a distinctly warm fluid having an elevated temperature suitable for fast and effective gas defrosting. In this manner, a cool fluid can be applied to the condenser during the refrigeration process and thus achieve the highest possible thermodynamic efficiency but a distinctly warm fluid can be applied to the condenser during the defrost process to achieve a fast and effective gas defrost. Since the distinctly warm fluid is used to facilitate the defrost process, it is termed the defrost fluid for the purpose of disclosing the present invention. The present invention also strives to maintain the temperature of the distinctly warm fluid by energy efficient means, most notably means which are more efficient than the electrical resistance means commonly employed for standard-practice electric defrost.

The present invention implements additional components relative to standard practice, specifically an energy-efficiency heater for maintaining the defrost fluid at an elevated temperature, conduits for transferring the defrost fluid to and from the stated heat exchangers, a pump for forcing the defrost fluid through the pipes and valves for guiding the condenser fluid to each condenser during the refrigeration mode and guiding the defrost fluid to each condenser during the defrost mode. With the application of these components, the refrigeration units can operate with a low condensing temperature during refrigeration mode to achieve a high thermodynamic efficiency and the refrigeration units can utilize a high temperature defrost fluid during defrost mode to facilitate a fast and effective defrost.

BRIEF DESCRIPTION OF THE DRAWINGS

FIG. 4 is a schematic diagram of a fluid-cooled refrigeration unit which utilizes the preferred embodiment of the present invention as shown by FIG. 3.

FIG. 5 is a sequence-of-events table applied to schematic diagram as shown by FIG. 4.

REFERENCE NUMERALS IN DRAWINGS

Reference Numerals Applied to all Drawings

Figure 1:
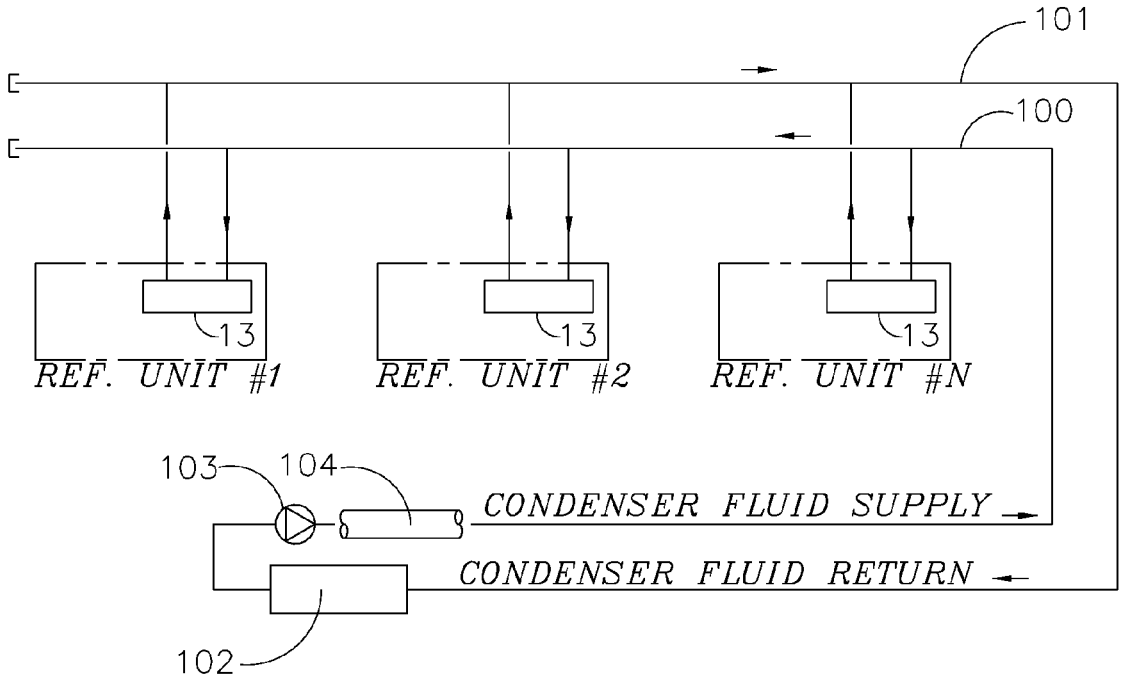
FIG. 1 Prior Art
FIG. 1 is a schematic diagram of a typical system for supplying a cooling fluid to fluid-cooled refrigeration units
Figure 2:
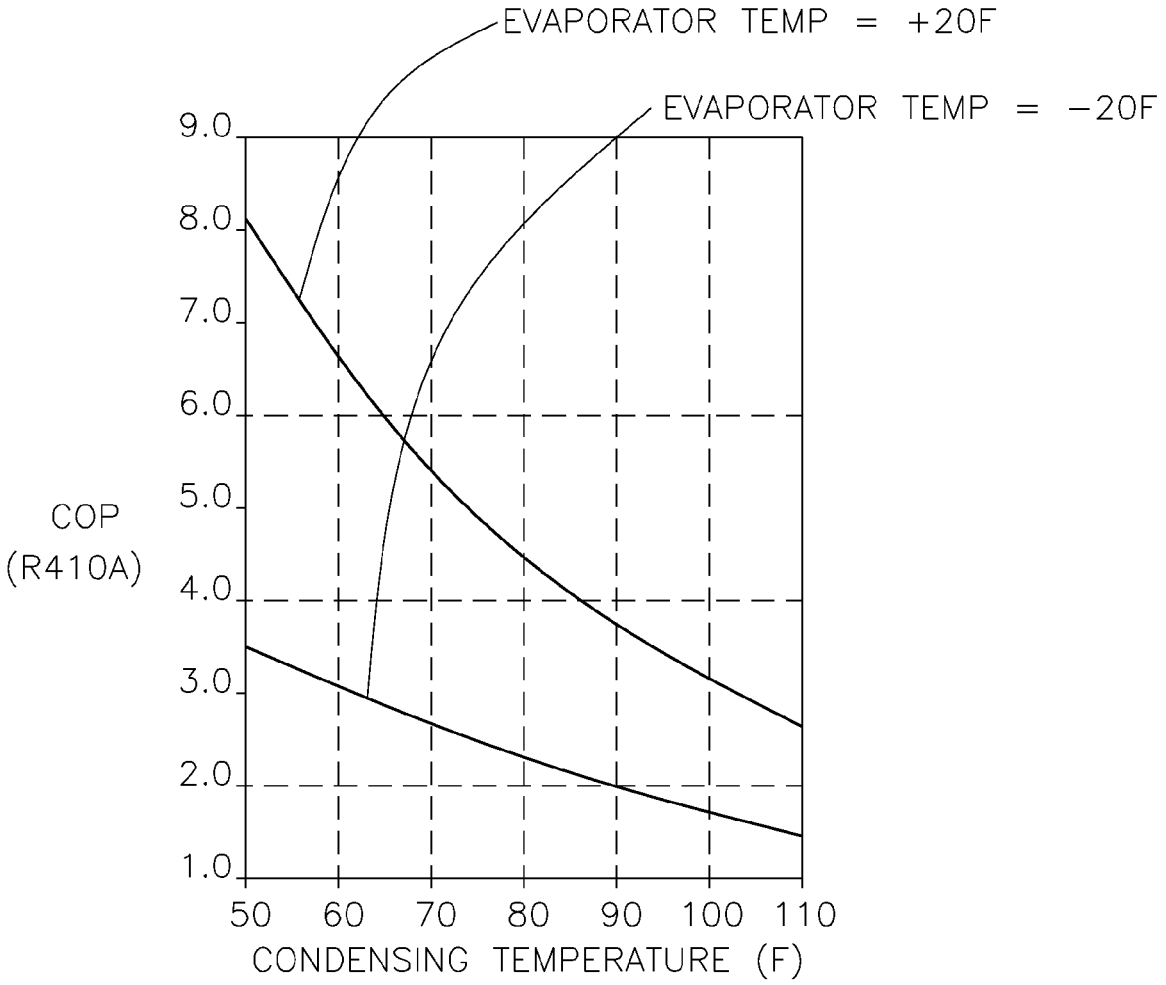
FIG. 2 is a graphical presentation of refrigeration efficiency as defined by the Coefficient-of-Performance (COP), using R410A as a refrigerant, for condensing temperatures ranging from 110 F to 50 F and evaporator temperatures of +20 F and −20 F.

10 Compressor
11 Evaporator
12 Fan
13 Condenser
15 Pipe
16 Pipe
17 Pipe

18 Valve
19 Pipe
20 Receiver
21 Pipe
22 Valve
23 Pipe
24 Expansion valve
25 Pipe
26 Pipe
27 Valve
28 Pipe
100 Condenser fluid supply pipe
101 Condenser fluid return pipe
102 Cooling unit
103 Condenser fluid pump
104 Condenser fluid
105 Defrost heat exchanger
106 Defrost fluid supply pipe
107 Defrost fluid return pipe
108 Defrost fluid heater
109 Defrost fluid pump
110 Defrost fluid
111 Valve
112 Valve

DETAILED DESCRIPTION OF THE INVENTION

Figure 3:
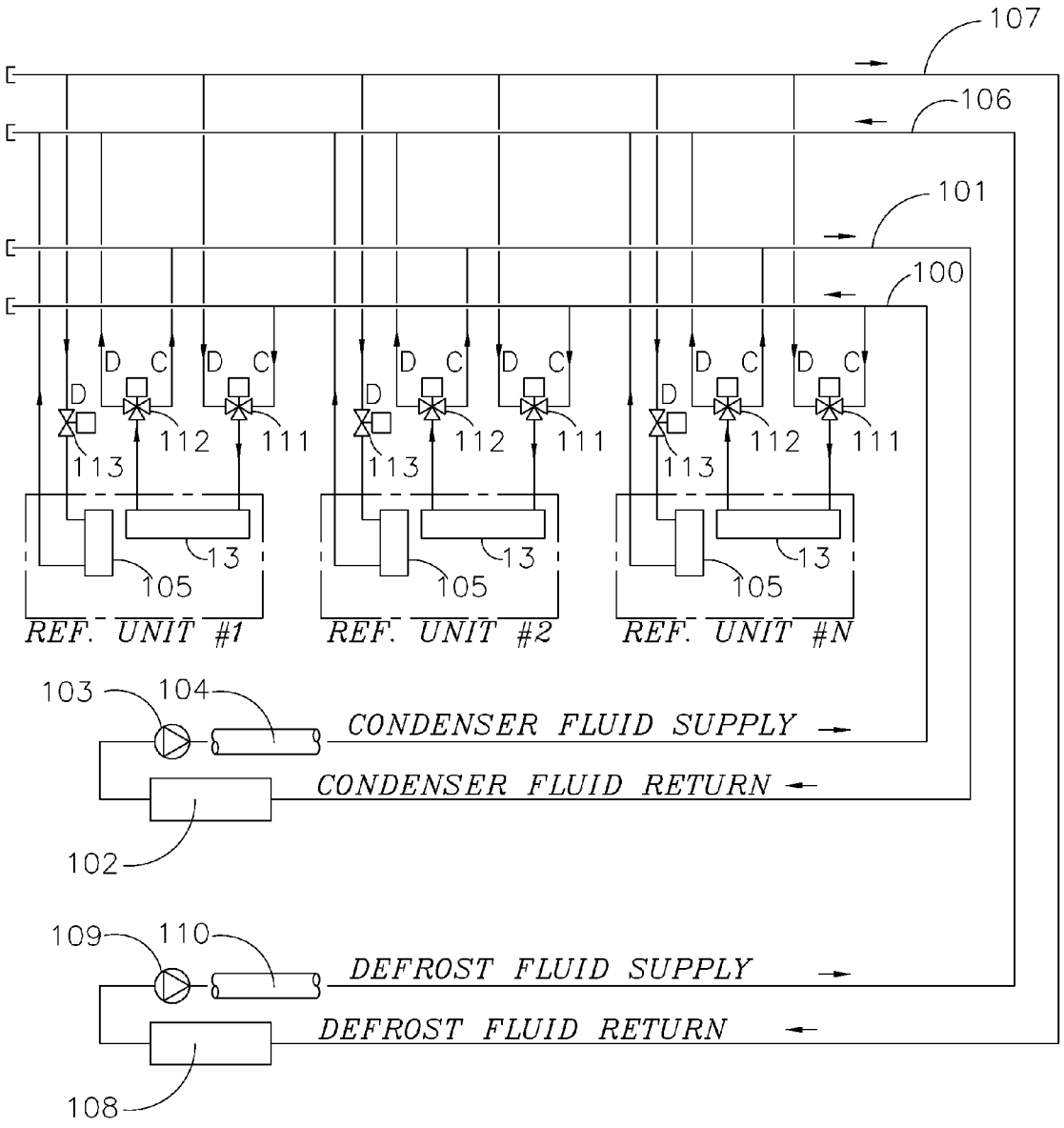
FIG. 3 is a schematic diagram of the preferred embodiment of the present invention, specifically an improved system for gas defrosting fluid-cooled refrigeration units.

The preferred embodiment of the present invention is presented by FIG. 3 which reveals a novel system for cooling and defrosting either a single or multiple fluid-cooled refrigeration units. Understanding of the present invention is further enhanced FIG. 4 and FIG. 5 which explain the gas defrost process for an individual fluid cooled refrigeration unit with the implementation of the present invention.

FIG. 3 shows the present invention applied to a system of either a single or multiple fluid-cooled refrigeration units. Relative to the common-practice system of fluid-cooled refrigeration units as shown FIG. 1, additional components are employed for the purpose of applying a warm defrost fluid during the defrost mode. Since the warm defrost fluid is used to facilitate the defrost process, this fluid is termed defrost fluid 110. Defrost fluid 110 is maintained at an elevated temperature by defrost fluid heater 108. Defrost fluid heater 108 is a common-practice fluid heater. In its most basic form, defrost fluid heater 108 is an electric water heater. But in order to minimize the cost of maintaining defrost fluid 110 at an elevated temperature, defrost fluid heater would ideally be as energy efficient as possible. Many fluid heating methods are readily available which provide a higher efficiency than an electric water heater, for example gas-fired water heaters, heat-pump type water heater and refrigeration heat recovery system.

Again referring to FIG. 3, defrost fluid return pipe 107 is connected to the inlet of defrost fluid heater 108. Defrost fluid heater 108 is designed to heat defrost fluid 110 to a temperature suitable for gas defrost, ideally greater than 80 F. The outlet of defrost fluid heater 108 is connected to the inlet of defrost fluid pump 109. The outlet of defrost fluid pump 109 is connected to defrost fluid supply pipe 106. Defrost fluid supply pipe 106, defrost fluid return pipe 107, defrost fluid heater 108 and defrost fluid pump 109 are filled with defrost fluid 110, which is a common heat transfer liquid such as water or glycol.

Each refrigeration unit contains a condenser 13 which must reject heat away from the refrigeration unit during the refrigeration process and this heat is typically called the "heat-of-rejection". Condenser 13 is a heat exchanger with a refrigerant-side and a fluid-side. The fluid inlet for condenser 13 for each refrigeration unit is connected to either condenser fluid supply pipe 100 or defrost fluid supply pipe 106 by the function of valve 111. Valve 111 is a two-position type and can be actuated by any means (for example, manually or electrically actuated). Valve 111 has two inlets and one outlet. The outlet of valve 111 is connected to the fluid inlet of condenser 13. One inlet of valve 111 is connected to condenser fluid supply pipe 100. The second inlet of valve 111 is connected to defrost fluid supply pipe 106. When valve 111 is in the position marked "C", flow is allowed from condenser fluid supply pipe 100 to the fluid inlet of condenser 13. When valve 111 is in the second position marked "D", flow is allowed from defrost fluid supply pipe 106 to the fluid inlet of condenser 13.

The fluid outlet for condenser 13 for each refrigeration unit is connected to either condenser fluid return pipe 101 or defrost fluid return pipe 107 by the function of valve 112. Valve 112 is a two-position type and can be actuated by any means. Valve 112 has one inlet and two outlets. The inlet of valve 112 is connected to the fluid outlet of condenser 13. One outlet of valve 112 is connected to condenser fluid return pipe 101. The second outlet of valve 112 is connected to defrost fluid return pipe 107. When valve 112 is in the first position marked "C", flow is allowed from the fluid outlet of condenser 13 to condenser fluid return pipe 101. When valve 112 is in the second position marked "D", flow is allowed from the fluid outlet of condenser 13 to defrost fluid return pipe 107.

The condenser fluid return pipe 101 is connected to the inlet of cooling unit 102. Cooling unit 102 is a fluid chiller, cooling tower or similar cooling device. The outlet of cooling unit 102 is connected to the inlet of condenser fluid pump 103. The outlet of condenser fluid pump 103 is connected to the condenser fluid supply pipe 100. Each condenser 13, condenser fluid supply pipe 100, condenser fluid return pipe 101 cooling unit 102 and condenser fluid pump 103 are filled with condenser fluid 104. Condenser fluid 104 has the identical composition as defrost fluid 110 and therefore incidental mixing of the two fluid has does alter the composition of the fluids. Then, when condenser fluid pump 103 is energized, condenser fluid 104 recirculates between condensers 13 to cooling unit 102 and thus transfers the heat-of-rejection away from condensers 13 to cooling unit 102.

The basic operation of the preferred embodiment as shown by FIG. 3 is now described. It is first noted that two modes of operation are required for each refrigeration unit. The first mode-of-operation is termed the refrigeration mode and refers to the function of providing useful cooling. The second mode-of-operation is termed the defrost mode and refers to the process of removing frost from the evaporator.

When refrigeration units are in refrigeration mode, valves 111 and valves 112 are in the "C" position and thus condenser fluid 104 is forced by condenser fluid pump 103 to recirculate from condenser fluid supply pipe 100 to condenser 13 to condenser fluid return pipe 101 and then to cooling unit 102. In this manner, the heat-of-rejection from condenser 13 is transferred to cooling unit 102 as required by the refrigeration process.

Also while the refrigeration units are in refrigeration mode, defrost fluid heater 108 maintains defrost fluid 110 at an elevated temperature required for gas defrost. When a refrigeration unit switches from refrigeration mode to defrost mode, valves 111 and valves 112 are switched from the "C" position to the "D" position and thus defrost fluid 110 is forced by defrost fluid pump 109 to recirculate from defrost fluid supply pipe 106 to condenser 13 to defrost fluid return pipe 107 and then to defrost fluid heater 108. In this manner, the distinctly warm defrost fluid is applied to condenser 13 to accomplish a fast and effective gas defrost.

It is now revealed that the defrost process can be made faster and more effective by employing additional heat transfer capability during the defrost process. Thus, to further enhance the present invention but at the disadvantage of additional cost, defrost heat exchanger 105 can inserted into the standard refrigeration unit. The fluid inlet for defrost heat exchanger 105 for each refrigeration unit is connected to defrost fluid supply pipe 106 by the function of valve 113. Valve 113 is a two-position type and can be actuated by any means. Valve 113 has one inlet and one outlet. The outlet of valve 113 is connected to the fluid inlet of defrost heat exchanger 105. The fluid outlet for defrost heat exchanger 105 for each refrigeration unit is connected to defrost fluid return pipe 107. Thus, when a refrigeration unit switches from refrigeration mode to defrost mode, valve 113 opens and defrost fluid 110 is forced by defrost fluid pump 109 to recirculate from defrost fluid supply pipe 106 to defrost heat exchanger 105 to defrost fluid return pipe 107 and then to defrost fluid heater 108. In this manner, the high temperature defrost fluid is applied to defrost heat exchanger 105 as well as condenser 13 to accomplish an even faster and more effective gas defrost.

And now to further illustrate the present invention, FIG. 4 shows the implementation of the present invention applied to an individual fluid-cooled refrigeration unit which uses gas defrost. As previously stated, many methods of gas defrost are available for the refrigeration practitioner but the method now described is the method preferred by the present inventor, having previously been disclosed by U.S. patent application Ser. No. 13/560,242 to Boyko. In FIG. 4, compressor 10 transfers refrigerant vapor from evaporator 11 to condenser 13. Evaporator 11 is connected to compressor 10 with pipe 15. Evaporator 11 is a heat exchanger which absorbs heat from the surrounding air. The surrounding air traverses evaporator 11 using fan 12. Compressor 10 is connected to condenser 13 with pipe 16. Inserted into pipe 15 is defrost heat exchanger 105. The fluid inlet for defrost heat exchanger 105 is connected to defrost fluid supply pipe 106 by the function of valve 113. Valve 113 is a two-position type and can be actuated by any means. Valve 113 has one inlet and one outlet. The outlet of valve 113 is connected to the fluid inlet of defrost heat exchanger 105. The fluid outlet for defrost heat exchanger 105 for each refrigeration unit is connected to defrost fluid return pipe 107. Thus when valve 113 opens, defrost fluid 110 flows from defrost fluid supply pipe 106 to defrost heat exchanger 105 and then to defrost fluid return pipe 107.

The fluid inlet for condenser 13 is connected to either condenser fluid supply pipe 100 or defrost fluid supply pipe 106 by the function of valve 111. Valve 111 is a two-position type and can be actuated by any means. Valve 111 has two inlets and one outlet. The outlet of valve 111 is connected to the fluid inlet of condenser 13. One inlet of valve 111 is connected to condenser fluid supply pipe 100. The second inlet of valve 111 is connected to defrost fluid supply pipe 106. When valve 111 is in the first position marked "C", flow is allowed from condenser fluid supply pipe 100 to the inlet of condenser 13. When valve 111 is in the second position marked "D", flow is allowed from defrost fluid supply pipe 106 to the inlet of condenser 13.

The fluid outlet for condenser 13 for each refrigeration unit is connected to either condenser fluid return pipe 101 or defrost fluid return pipe 107 by the function of valve 112. Valve 112 is a two-position type and can be actuated by any means. Valve 112 has one inlet and two outlets. The inlet of valve 112 is connected to the fluid outlet of condenser 13. One outlet of valve 112 is connected to condenser fluid return pipe 101. The second outlet of valve 112 is connected to defrost fluid return pipe 107. When valve 112 is in the first position marked flow is allowed from the fluid outlet of condenser 13 to condenser fluid return pipe 101. When valve 112 is in the second position marked "D ", flow is allowed from the fluid outlet of condenser 13 to defrost fluid return pipe 107.

Refrigerant can be transferred to evaporator 11 along two alternate paths, marked on FIG. 4 as "A" and "B". Along path "A", condenser 13 is connected to valve 18 with pipe 17. Valve 18 is connected to receiver 20 with pipe 19. Valve 18 is of the two-position type (either open or closed) and can be actuated by any means. Receiver 20 is a storage vessel of sufficient size to store all of the liquid refrigerant within the refrigeration system. Receiver 20 is connected to valve 22 with pipe 21. Valve 22 is of the two-position type and can be actuated by any means. Valve 22 is connected to expansion valve 24 with pipe 23. Expansion valve 24 is connected to evaporator 11 with pipe 25. In summary, a continuous path "A" is formed from condenser 13 to evaporator 11 by the sequential connection of parts 17-18-19-20-21-22-23-24-25. Along path "B", condenser 13 is connected to valve 27 with pipe 26. Valve 27 is of the two-position type (either open or closed) and can be actuated by any means. Valve 27 is connected to evaporator 11 with pipe 28. In summary, an alternate continuous path "B" is formed from condenser 13 to evaporator 11 by the sequential connection of parts 26-27-28.

The operation of the gas defrost method with implementation of the present invention is now described. During the process of refrigeration, compressor 10 pressurizes refrigerant vapor to a hot, high-pressure state. The high-pressure vapor then flows to condenser 13. Valve 111 and valve 112 are in the position marked as "C" and therefore condenser fluid 104 traverses condenser 13, causing heat to flow from the high-pressure vapor to the condenser fluid 104 and subsequently causing the high-pressure vapor to condense into a high-pressure liquid. Valve 113 is closed and therefore defrost fluid 110 is prevented from traversing defrost heat exchanger 105 since the introduction of heat from defrost fluid 110 would be detrimental to the refrigerant process. Valve 18 and valve 22 are open and therefore the high pressure liquid is allowed to flow to evaporator 11 along path Valve 27 is closed and therefore flow is prevented along Path "B". While flowing along path "A", expansion valve 24 imparts a significant loss in pressure to the high-pressure liquid, causing the high-pressure liquid to expand to cold low-pressure mixture of liquid and vapor before entering evaporator 11.

The surrounding air traverses evaporator 11 using energized fan 12, causing heat to flow from the surrounding air to the cold low-pressure mixture of liquid and vapor, causing the mixture to transition to cold low-pressure vapor. The cold low-pressure vapor travels to compressor 10 through pipe 15. The cold low-pressure vapor is then re-compressed to hot, high-pressure vapor to complete the refrigeration cycle.

As heat is removed from evaporator 11, frost can form on the outside surface of evaporator 11 if the outside surface of evaporator 11 is below the freezing point of water and the surrounding air contains water vapor. This formation of frost will eventually impede the surrounding air from traversing evaporator 11 and thus becomes an impediment to the transfer of heat. At this point in time, the frost must be removed from evaporator 11 with a process typically called "defrosting".

Gas defrosting is accomplished by implementing distinct steps: Defrost Step #1 is initiated by closing valve 22. With the closing of valve 22, high pressure liquid refrigerant is prevented from flowing to evaporator 11 and subsequently the residual liquid refrigerant within evaporator 11 is quickly transformed to a vapor and transferred by compressor 10 to condenser 13. Within condenser 13, the vapor condenses to a liquid state and the liquid travels through valve 18 to receiver 20. Defrost Step #1 is terminated when all of the liquid refrigerant within the refrigeration system has been stored in receiver 20. Thus at the termination of Defrost Step #1, evaporator 11 and condenser 13 contain only refrigerant vapor.

Defrost Step #1 is terminated and then Defrost Step #2 is initiated by switching valve 111 and valve 112 to the posit marked as "D", closing valve 18, opening valve 27, opening valve 22 and de-energizing fan 12. With valve 111 and valve 112 in the "D" position, warm defrost fluid 110 transverses condenser 13. With valve 18 closed, liquid refrigerant stored in receiver 20 is not allowed to leave receiver 20 through pipe 19. With valve 27 open, refrigerant vapor can freely recirculate from condenser 13 to evaporator 11 to compressor 10 along Path "B". Thus refrigerant vapor recirculating from condenser 13 to evaporator 11 to compressor 10 remains in a vapor state and compressor 10 is protected from damage due to receiving refrigerant in the liquid state. It is now noted that defrost fluid 110 which traverses condenser 13 is substantially warmer than evaporator 11 in its frosted state and therefore heat is transferred from defrost fluid 110 to the refrigerant vapor as the refrigerant vapor flows through condenser 13 and then from the refrigerant vapor to evaporator 11 as the refrigerant vapor flows through evaporator 11. When fan 12 is de-energized, the stated heat is not transferred to the surrounding air but instead is fully applied to the frost on the outside surfaces of evaporator 11 and consequentially the frost starts to convert to a liquid and drips off of evaporator 11 thus initiating the defrost process.

With the opening of valve 22, high pressure liquid refrigerant is allowed to flow to expansion valve 24 and subsequently expansion valve 24 introduces liquid refrigerant into the refrigerant vapor recirculating from condenser 13 to evaporator 11 to compressor 10. Since the stated recirculating refrigerant vapor is in a superheated state, the liquid refrigerant introduced by expansion valve 24 is vaporized. By virtue of its purposeful design, expansion valve 24 introduces liquid refrigerant into the stated recirculating refrigerant vapor only as required to maintain the vapor traveling to compressor 10 in a slightly superheated state and thus compressor 10 remains protected from damage due to receiving refrigerant in the liquid state. Defrost Step #2 is terminated when all of frost has been removed from evaporator 11.

It is now revealed that the Defrost Step #2 process can be enhanced by opening valve 113, thus allowing fluid warm defrost fluid 110 to transverse defrost heat exchanger 105 and further warm the stated recirculating refrigerant vapor. It is also now revealed that the placement of defrost heat exchanger 105 prior to the superheat sensing function of expansion valve 24 increases the superheated state of the refrigerant vapor as sensed by expansion valve 24. To compensate for the increased superheated state, expansion valve 24 further introduces liquid refrigerant into the refrigerant vapor, thereby increasing the density of the refrigerant vapor and subsequently increasing the transfer of heat from defrost fluid 110 to evaporator 11.

FIG. 5 delineates the sequence of events in tabular form for the gas defrost method with the implementation of the present invention. Three distinct modes of operations are shown: normal refrigeration and the two steps of defrost. For normal refrigeration, compressor 10 is energized, fan 12 is energized, valve 111 is in the "C" position, valve 112 is in the "C" position, valve 113 is closed, valve 18 is open, valve 22 is open and valve 27 is closed. Normal refrigeration is terminated and Defrost Step #1 is initiated when excessive frost has accumulated on the outside surface of evaporator 11. Defrost Step #1 is initiated by closing valve 22. Defrost Step #1 is terminated and Defrost Step #2 is initiated when all of the liquid refrigerant is stored within receiver 20. For Defrost Step #2 is initiated by de-energizing fan 12, switching valve 111 to the "D" position, switching valve 112 to the "D" position, opening valve 113, closing valve 18, opening valve 22 and opening valve 27. Defrost Step #2 is terminated and the system returns to normal refrigeration when all of the frost has been removed from evaporator 11.

In conclusion, the preferred embodiment of the present invention provides a gas-defrost system applicable to fluid-cooled refrigeration units which can operate with a low temperature condensing fluid during refrigeration mode and thus achieve a high thermodynamic efficiency but also can utilize a distinctly warm defrost fluid during defrost mode and thus accomplish a fast and effective defrost. In addition, the preferred embodiment of the present invention can be readily implemented with basic, well-understood components and therefore deemed to be practical and commercially viable.

It should be understood that the preferred embodiment is merely illustrative of the present invention. Numerous variations in design and use of the present invention may be contemplated in view of the following claims without straying from the intended scope and field of the invention disclosed herein.

I claim:

1. A system for defrosting refrigeration units, the system comprising:

single or multiple refrigeration units, each of said refrigeration units comprising a compressor, a condenser, an evaporator, and an expansion valve, wherein each of said refrigeration units is operable in:

a refrigeration mode during which said refrigeration units are applied for providing useful cooling, and a defrost mode during which a gas defrost method is applied for removing frost from said evaporator;

a condenser fluid circuit comprising at least a condenser fluid supply line and a condenser fluid return line, each coupled to the condenser and configured to circulate a condenser fluid to the condenser during the refrigeration mode;

a defrost heat exchanger disposed between the evaporator and the compressor;

a defrost fluid circuit comprising at least a defrost fluid supply line and a defrost fluid return line, each coupled to the condenser and configured to circulate a defrost fluid to the condenser during the defrost mode, and each coupled to the defrost heat exchanger and configured to circulate the defrost fluid to the defrost heat exchanger during the defrost mode;

a condenser inlet valve having a first inlet port fluidly connected to the condenser fluid supply line and a second inlet port fluidly connected to defrost fluid supply line, and an outlet port fluidly connected to an inlet of the condenser; and a condenser outlet valve having a first outlet port fluidly connected to the condenser fluid return line and a second outlet port fluidly connected to defrost fluid return line, and an inlet port fluidly connected to an outlet of the condenser.

2. The system for defrosting refrigeration units of claim 1, wherein a temperature of said defrost fluid equals or exceeds 80 degrees F.

3. The system for defrosting refrigeration units of claim 1, wherein said condenser fluid and said defrost fluid have an identical chemical composition.

4. The system for defrosting refrigeration units of claim 1, wherein the defrost fluid is circulated through the defrost heat exchanger and the condenser in a parallel flow arrangement.

5. The system for defrosting refrigeration units of claim 1, wherein said expansion valve is configured to sense an amount of superheat of a fluid refrigerant circulated by said refrigeration units using a sensor positioned between said defrost heat exchanger and said compressor.

6. The system for defrosting refrigeration units of claim 1, wherein a temperature of said defrost fluid is maintained by a defrost fluid heater having a higher efficiency relative to electric resistance heating.

7. The refrigeration system of claim 1, wherein the condenser fluid circuit and the defrost fluid circuit have a shared flow path between the condenser inlet valve and the condenser outlet valve, and wherein the condenser is fluidly disposed along the shared flow path between the condenser inlet valve and the condenser outlet valve.

8. A refrigeration system comprising:

a refrigeration circuit comprising a condenser, an evaporator, and a compressor configured to circulate a fluid refrigerant through the condenser and the evaporator;

a condenser fluid circuit separate from the refrigeration circuit and configured to circulate a chilled condenser fluid through the condenser to provide cooling for the fluid refrigerant in the condenser when the refrigeration system is operated in a refrigeration mode;

a defrost fluid circuit separate from the refrigeration circuit and configured to circulate a heated defrost fluid through the condenser to provide heating for the fluid refrigerant in the condenser when the refrigeration system is operated in a defrost mode; and one or more valves configured to switch between circulating the chilled condenser fluid through the condenser in the refrigeration mode and circulating the heated defrost fluid through the condenser in the defrost mode, wherein the one or more valves comprise:

a condenser inlet valve having a first inlet port fluidly connected to a supply line for the chilled condenser fluid, a second inlet port fluidly connected to a supply line for the heated defrost fluid, and an outlet port fluidly connected to an inlet of the condenser; and a condenser outlet valve having an inlet port fluidly connected to an outlet of the condenser, a first outlet port fluidly connected to return line for the chilled condenser fluid, and a second outlet port fluidly connected to a return line for the heated defrost fluid.

9. The refrigeration system of claim 8, wherein the condenser fluid circuit and the defrost fluid circuit have a shared flow path between the condenser inlet valve and the condenser outlet valve;

wherein the condenser is disposed along the shared flow path between the condenser inlet valve and the condenser outlet valve.

10. The refrigeration system of claim 8, further comprising:

a heat exchanger disposed in series between the evaporator and the compressor of the refrigeration circuit and fluidly connected to the defrost fluid circuit;

wherein the heat exchanger is configured to heat the fluid refrigerant between the evaporator and the compressor using heat from the heated defrost fluid when the refrigeration system is operated in the defrost mode.

11. The refrigeration system of claim 8, the condenser fluid circuit comprising:

a cooling unit configured to provide cooling for the chilled condenser fluid; and a condenser fluid pump configured to circulate the chilled condenser fluid between the cooling unit and the condenser.

12. The refrigeration system of claim 8, the defrost fluid circuit comprising:

a defrost fluid heater configured to provide heating for the heated defrost fluid; and a defrost fluid pump configured to circulate the heated defrost fluid between the defrost fluid heater and the condenser.

13. The refrigeration system of claim 12, wherein the defrost fluid heater is configured to maintain the heated defrost fluid at a gas defrost temperature while the refrigeration system is operated in the refrigeration mode;

wherein the gas defrost temperature is higher than a temperature of the chilled condenser fluid.

* * * * *